US007086112B2

(12) United States Patent
Smith et al.

(10) Patent No.: US 7,086,112 B2
(45) Date of Patent: Aug. 8, 2006

(54) PAINT BRUSH AND MAKEUP BRUSH CLEANING DEVICE

(75) Inventors: Martin Smith, Los Angeles, CA (US); Ted Brackett, Manhattan Beach, CA (US)

(73) Assignee: Dynamic Cleaning Technologies, LLC, Los Angeles, CA (US)

( * ) Notice: Subject to any disclaimer, the term of this patent is extended or adjusted under 35 U.S.C. 154(b) by 0 days.

(21) Appl. No.: 10/731,364

(22) Filed: Dec. 9, 2003

(65) Prior Publication Data

US 2004/0181887 A1 Sep. 23, 2004

Related U.S. Application Data

(63) Continuation-in-part of application No. 10/002,365, filed on Nov. 1, 2001, now Pat. No. 6,666,925.
(60) Provisional application No. 60/245,078, filed on Nov. 1, 2000.

(51) Int. Cl.
*A46B 17/06* (2006.01)

(52) U.S. Cl. ..... 15/38; 15/21.1
(58) Field of Classification Search ..... 15/21.1, 15/38, 39, 88.4, 104.92
See application file for complete search history.

(56) References Cited

U.S. PATENT DOCUMENTS

| | | | | | |
|---|---|---|---|---|---|
| 1,377,310 | A | * | 5/1921 | Chartier | 15/39 |
| 1,542,025 | A | * | 6/1925 | Ballman | 15/38 |
| 2,082,991 | A | * | 6/1937 | Turco | 15/39 |
| 2,354,898 | A | * | 8/1944 | Wiksten | 15/3 |
| 3,058,134 | A | * | 10/1962 | Wozniak-Rennek | 15/38 |
| 4,018,240 | A | | 4/1977 | Palthe | |
| 4,403,364 | A | * | 9/1983 | Schroeder | 15/4 |
| 4,759,384 | A | | 7/1988 | Kliewer | |
| 4,823,424 | A | | 4/1989 | Allen | |
| 4,827,554 | A | | 5/1989 | Cain | |
| 4,912,797 | A | | 4/1990 | Brackett | |
| 5,097,967 | A | | 3/1992 | Sica | |
| 5,107,877 | A | | 4/1992 | Chipman | |
| 5,213,121 | A | | 5/1993 | O'Brien et al. | |
| 5,351,350 | A | | 10/1994 | Johnson | |
| 5,626,158 | A | | 5/1997 | Gratopp | |
| 5,701,626 | A | * | 12/1997 | Zara et al. | 15/38 |

FOREIGN PATENT DOCUMENTS

| | | | |
|---|---|---|---|
| GB | 421134 | | 12/1939 |
| WO | 90/11900 | * | 10/1990 |

* cited by examiner

*Primary Examiner*—Mark Spisich
(74) *Attorney, Agent, or Firm*—Cislo & Thomas LLP

(57) ABSTRACT

The present invention thoroughly cleans paintbrushes, arts & crafts brushes, artist brushes and cosmetic brushes and comprises a tank with an open top for containing cleaning fluid, a brush frame, rotating cleaning brushes, a motor housing and top cover. The rotating cleaning brushes, together with the stationary cleaning brush, remove paint or cosmetic materials from the brushes to be cleaned. The rotating and stationary cleaning brushes each bear a bristle portion comprising tufts, which are configured in a specialized tightly packed pattern to optimize cleaning the paintbrushes artists brushes, arts & crafts brushes or cosmetic brushes to be cleaned.

18 Claims, 6 Drawing Sheets

FIG. 2A
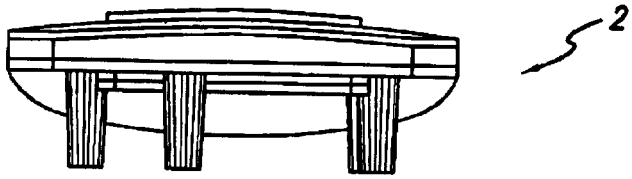
FIG. 2B
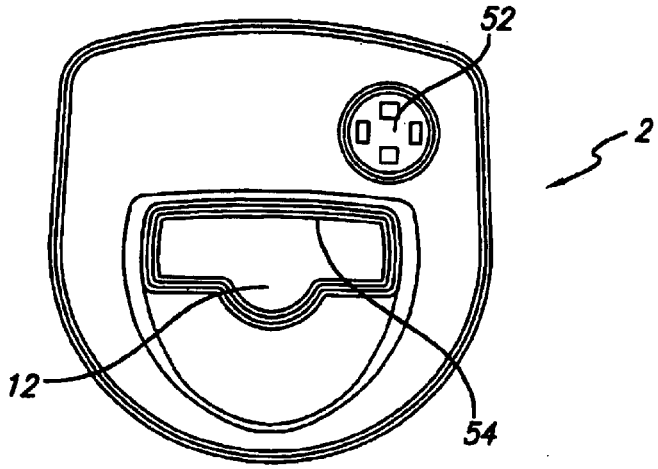
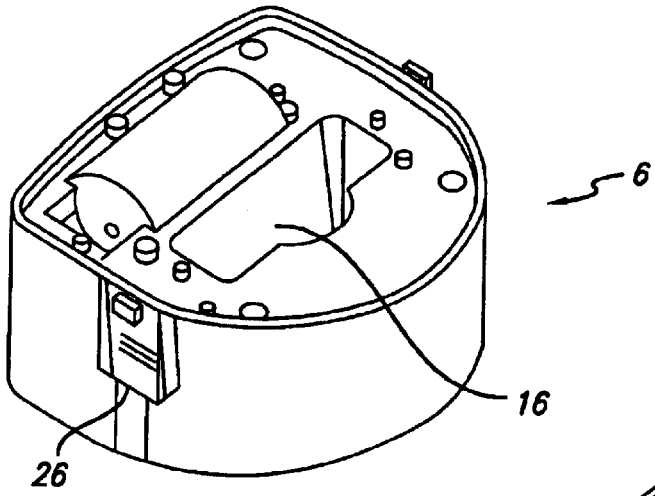
FIG. 3A
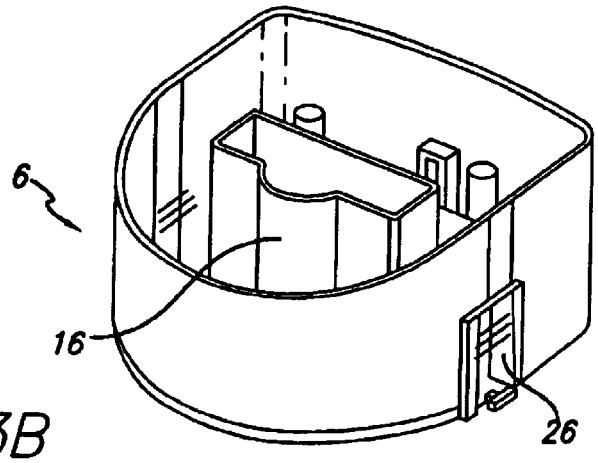
FIG. 3B

PAINT BRUSH AND MAKEUP BRUSH CLEANING DEVICE

CROSS-REFERENCES TO RELATED APPLICATIONS

This patent application is a continuation-in-part of application Ser. No. 10/002,365, filed Nov. 1, 2001, now U.S. Pat. No. 6,666,925, which claims priority from U.S. Provisional Patent Application Ser. No. 60/245,078 filed Nov. 1, 2000, which applications are incorporated herein by this reference thereto. This application is related to U.S. Pat. No. 4,912,797, also hereby incorporated by this reference.

COPYRIGHT AUTHORIZATION

A portion of the disclosure of this patent document contains material which is subject to copyright protection. The copyright owner has no objection to the facsimile reproduction by any one of the patent disclosure as it appears in the U.S. Patent and Trademark Office patent files or records, but otherwise reserves all copyright rights whatsoever.

BACKGROUND OF THE INVENTION

Field of the Invention

The present invention relates generally to a cleaning device, and more particularly a brush cleaning device that can be used to clean, for example, artists brushes, paint brushes, arts & crafts brushes and to flush, clean and sanitize cosmetic brushes.

SUMMARY OF THE INVENTION

The instant invention is directed to a cleaning device that incorporates optimized physical brushing action, water agitation, submersion and/or solution directional features to clean artist brushes, paint brushes, and which cleans, flushes and sanitizes cosmetic brushes. In general, the device comprises a tank, brush frame and brush assembly, a motor housing and a top cover. The tank may have a substantially flat bottom and upraised sidewalls defining an interior or central space communicating with an open or partially open top, and is configured to contain water or cleaning solution. The tank may be comprised of a transparent or translucent material to allow the operator to observe the cleaning process. The top cover preferably comprises a throat opening, in which one or a plurality of paintbrushes, cosmetic brushes or artist brushes can be inserted so that the bristle portion of each brush to be cleaned and/or sanitized is optimally oriented in the device for cleaning.

In the preferred embodiment, cleaning brushes, including a pair of rotating cleaning means or rotating brushes, together with a single stationary cleaning means or stationary brush have a specialized bristle pattern. The stationary brush and the rotating brushes in the preferred embodiment are arranged in an inverted triangular configuration, so that bristle-to-bristle contact between the cleaning brushes and the artist brush, arts & crafts brush, cosmetic brush or paintbrush to be cleaned or sanitized is optimal. In the preferred embodiment, at least one of the rotating brushes preferably comprises a bristle portion configured in a specialized densely packed pattern and/or a double radial spiral pattern about a support column. In the preferred embodiment, rotation may be imparted to the rotating brushes by, for example, an electric or battery operated motor, which engages one or more gears communicating with the rotating brushes.

In the preferred embodiment, the tank receives water or other cleaning liquid and the rotating and stationary brushes are configured so that thorough cleaning and movement of the cleaning fluid can be accomplished without the need for injecting or pressurizing the cleaning liquid. The preferred embodiment is self-contained, portable and lightweight and achieves thorough cleaning and/or sanitizing of brushes without the need for hose connections or plumbing systems and permits several brushes to be cleaned simultaneously. Water agitation and specialized cleaning means or brushes having a specialized pattern of bristles permits any artist brush, paintbrush, arts & crafts brush or cosmetic brush to be thoroughly cleaned or sanitized within about a minute or less without shaking, damaging, bending or rotating the paintbrushes themselves. The device may be used to clean brushes used with oil-based as well as water-based paints and makeup.

Various other features of the present invention are set forth in the following detailed description and accompanying drawings.

BRIEF DESCRIPTION OF THE DRAWINGS

FIG. 2(*a*) is a top view of the top cover of the brush-cleaning device according to a preferred embodiment of the present invention.

FIG. 2(*b*) is a lower side perspective view of the top cover according to a preferred embodiment of the present invention.

FIG. 3(*a*) is a bottom side perspective view of the motor housing according to a preferred embodiment of the present invention.

FIG. 3(*b*) is a top side perspective view of the motor housing according to a preferred embodiment of the present invention.

FIG. 4(*b*) is a side view of the tank according to a preferred embodiment of the present invention.

FIG. 4(*c*) is an enlarged view of the latch catch shown in FIG. 4(*b*).

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for operating the invention in connection with the illustrated embodiments. However, it is to be understood that the same or equivalent functions and sequences may be accomplished by different embodiments that are also intended to be encompassed within the spirit and scope of the invention. References to top/bottom, right/left etc. are relative terms provided for clarity and, unless otherwise noted, are interchangeable.

Figure 1:
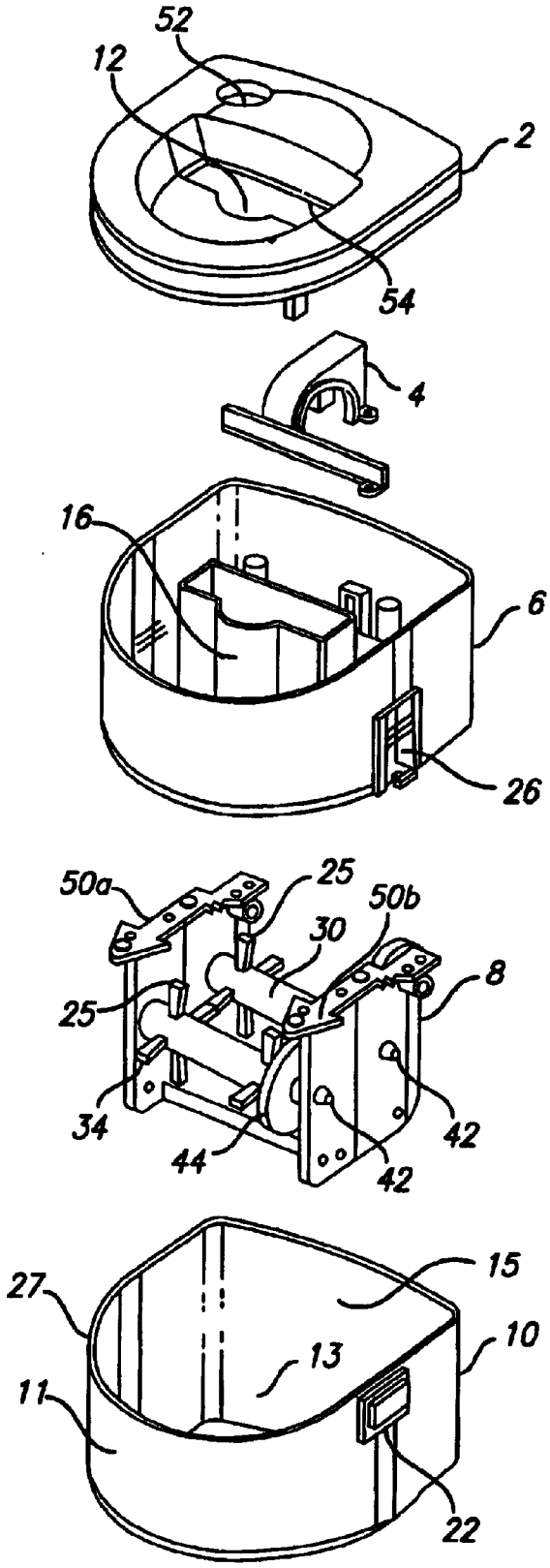
FIG. 1 is an exploded perspective side view of the top cover, motor cowling, motor housing, brush assembly and tank components of the device according to a preferred embodiment of the present invention.

Referring to FIGS. 1–8 of the drawings, the device of the preferred embodiment generally comprises a top cover 2 (FIGS. 1–2), a motor housing 6 (FIG. 1, FIGS. 3*a*, 3*b*), and a brush frame 8 (FIG. 1) comprising cleaning means or cleaning brushes 30 (FIG. 1). The top cover 2 may be comprised of a molded plastic material such as, for example, ABS plastic or high-density polyethylene plastic, but may be also be formed of other suitable materials such as steel, other metals or plastics.

In a first example of the preferred embodiment ("Example I"), the top cover 2 may have a length of preferably approximately 10 cm to about 200 cm, is more preferably from about 25 cm to about 150 cm in length, and is most preferably approximately 50 cm to about 100 cm in length, or about 78 cm in length. The top cover 2 may be preferably between about 25 cm wide to about 250 cm wide, is more preferably about 50 cm to about 200 cm wide, and is most preferably between about 100 cm to about 175 cm or, about 152 cm wide. The top cover preferably has a depth of between about 25 cm to about 250 cm, is more preferably about 50 cm to about 200 cm deep, and is most preferably between about 100 cm to about 175 cm deep, or about 152 cm deep. The dimensions, however, may be varied depending upon the desired cleaning application.

The top cover 2 in the preferred embodiment comprises a tongue opening 12 on its upper surface (FIG. 2(*a*)). In the preferred embodiment, a tongue 16 may be continuous with the tongue opening 12 and project downward from the tongue opening 12 toward the motor housing 6 from the rear face of the top cover 2. Alternately, the tongue 16 may be continuous with or attached to the motor housing 6 and project upwards towards the tongue opening 12 and top cover 2 (FIGS. 3(*a*), 3(*b*)).

In the preferred embodiment, the tank 10 comprises a bottom 48 and walls 11 defining an interior 13 and has top opening 15. The tank 10 is preferably comprised of polyethylene or an equivalent, although various materials such as metals and other plastics will be suitable.

The motor housing 6, in the preferred embodiment, is preferably configured to interface with the brush frame 8 at one end such as its lower end, and with the top cover 2 at its upper, or opposite end (FIG. 1). By way of example only, in Example I, the motor housing 6 is preferably approximately between about 25 cm to about 250 cm high, is more preferably between about 50 cm to about 200 cm high, and is most preferably between about 75 cm to about 150 cm high, or about 79 cm high. In Example I, the motor housing 6 is preferably between about 25 cm to about 300 cm wide, is more preferably between about 50 cm to about 200 cm wide and is most preferably between about 75 cm and about 150 cm wide, or about 154 cm wide. In Example I, the motor housing 6 is preferably between about 25 cm to about 300 cm deep is more preferably between about 50 cm to about 200 cm deep and is most preferably between about 100 cm to about 175 cm deep, or about 153 cm deep. The motor housing 6 may be comprised of ABS molded plastic, although other materials such as metals and other plastics will be suitable. In the preferred embodiment, a motor cowling 4 secures a motor (not shown) in place in the motor housing 6 to drive the rotating brushes 30 and also serves to cool the motor by permitting the circulation of air from inside and outside of the motor housing 6.

Figure 5:
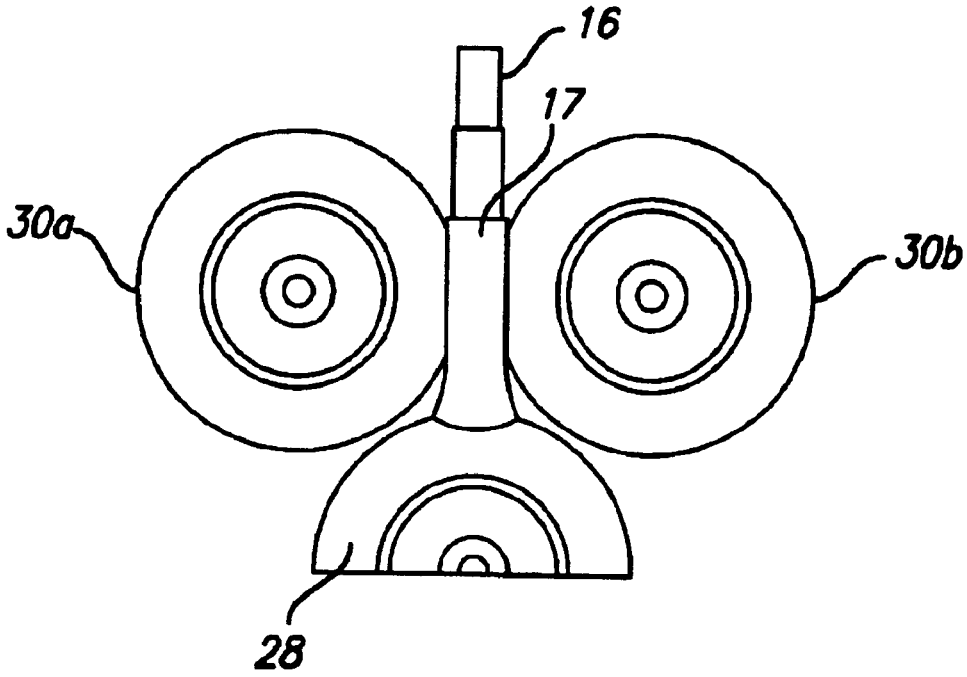
FIG. 5 is a side view of the stationary brush and rotating brushes according to a preferred embodiment of the present invention.
Figure 6:
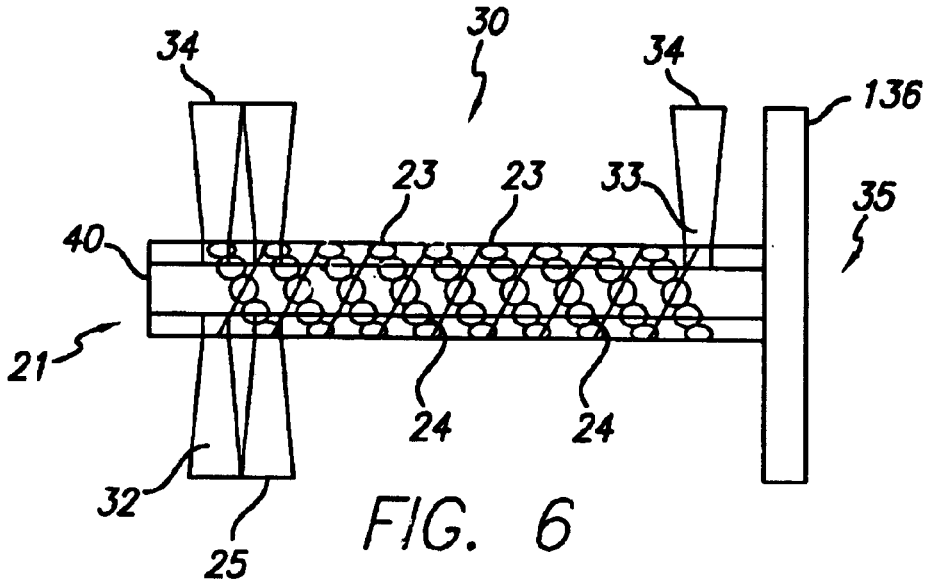
FIG. 6 is a side view of the rotating brush showing a spiral bristle pattern and representative bristle tufts
Figure 7:
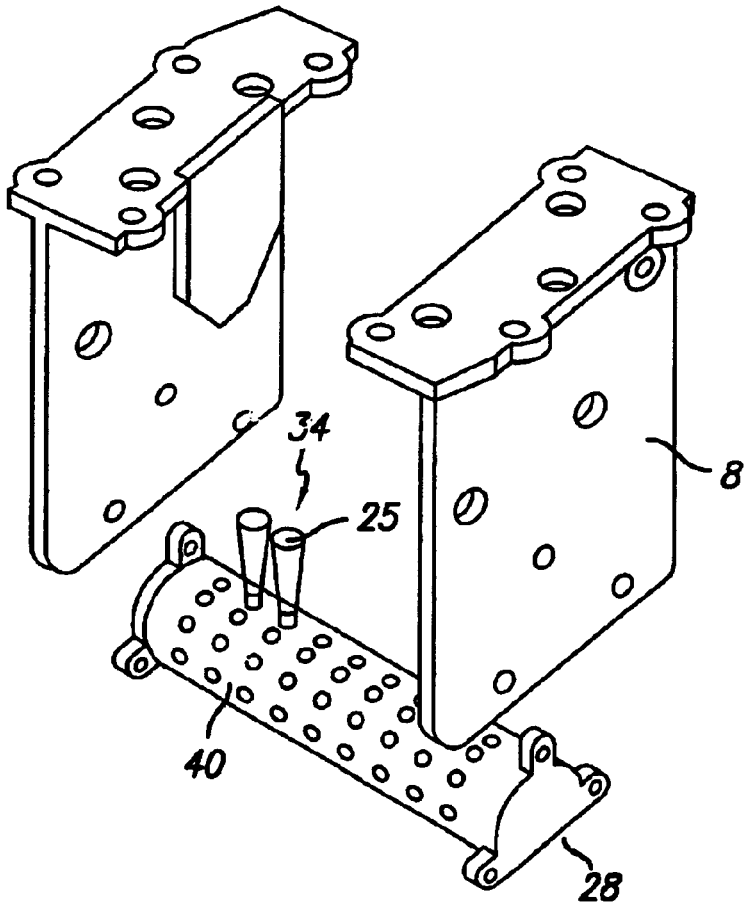
FIG. 7 is an exploded view of a portion of the brush assembly that interfaces with the stationary brush.
Figure 8:
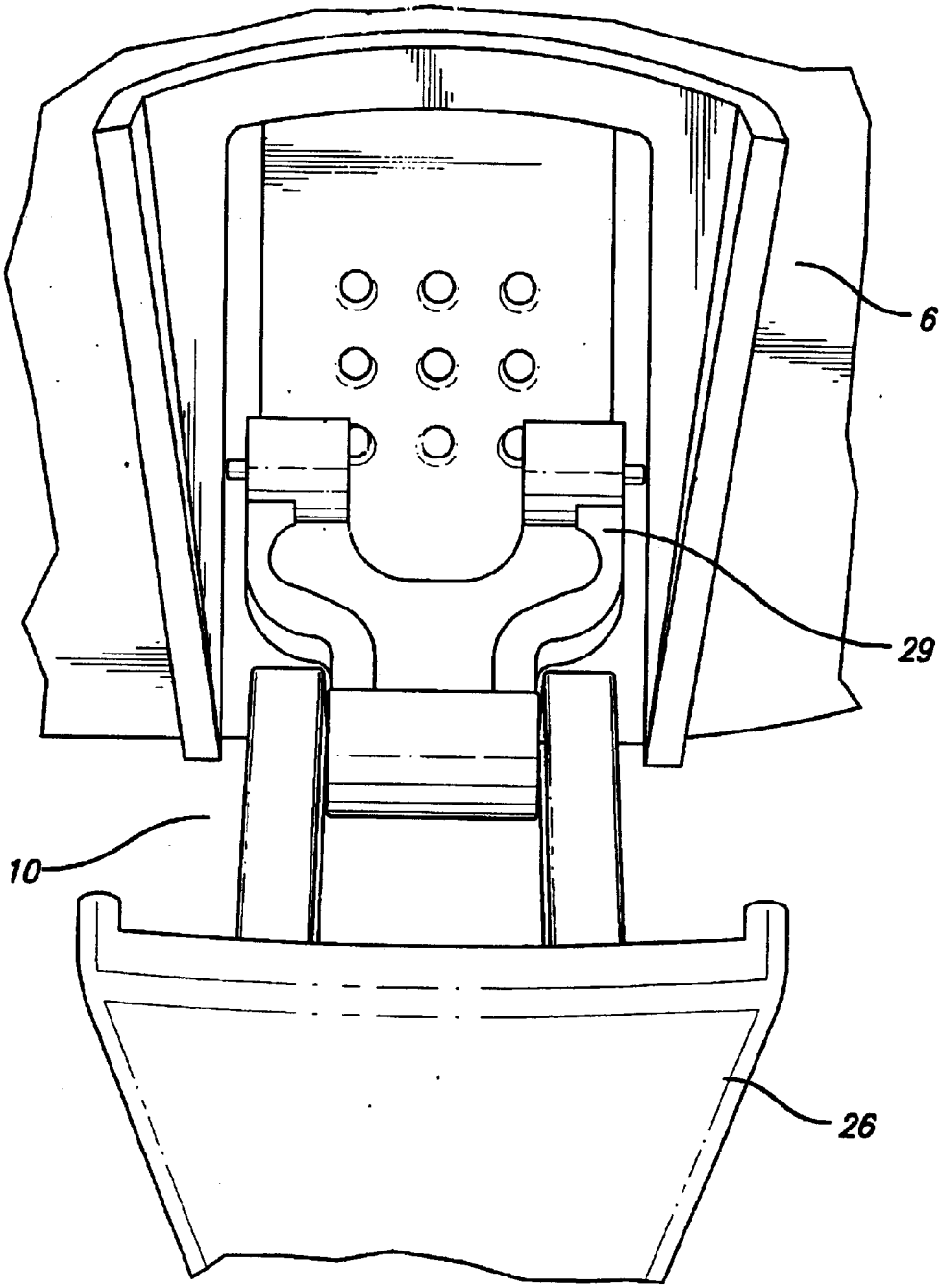
FIG. 8 is a side view of the latch handle and Y arm.

In the preferred embodiment, the brush frame 8 preferably comprises a set of three (3) cleaning brushes, including a stationary brush 28 and two (2) rotating brushes 30(*a*) and 30(*b*) (see FIGS. 5–7). The stationary brush 28 and rotating brushes 30*a*, 30*b* are preferably configured in an inverted triangle arrangement with the rotating brushes 30*a*, 30*b* being disposed parallel to one another and above the stationary brush 28. The stationary brush 28 may be disposed between the lower ends of the brush frame 8 such that it serves as a structural support to the brush frame 8 (see e.g. FIG. 7). In a first variation of the preferred embodiment, the device comprises three rotating brushes in a inverted triangle pattern. In a second variation of the preferred embodiment, the paint brush cleaning device comprises a single pair of rotating brushes, and in a third variation of the preferred embodiment, comprise a pair of brushes including one rotating and one stationary brush. Additional brush configurations may be used, depending upon the desired application.

In the preferred embodiment, the stationary and rotating brushes 30*a*, 30*b*, 28 each comprise a bristle portion 21, which in turn comprises individual tufts. The stationary brush 28 and rotating brushes 30*a*, 30*b* each preferably comprise a support column and the bristle portion 21 is preferably disposed along the length of the support column 40. The size, density and pattern of the tufts 34 as arranged in the bristle portion of the stationary brush 28 and rotating brushes 30 are configured to provide optimal bristle-to-bristle contact between the cleaning brushes (the stationary brush 28 and rotating brushes 30*a*, 30*b*) and the paint brush, artist brush, cosmetic brush, or arts & crafts brush to be cleaned or sanitized.

In the preferred embodiment, at least a portion of the tufts 34 are preferably cone-shaped, with the wide portion 32 of the cone preferably disposed distal to the support column 40. The tufts 34 are preferably arranged along the brush support column 40 to achieve a maximum tight pattern. In Example I of the preferred embodiment, for example, individual tufts 34 may be disposed in the brush support column 40 in tuft holes 23, and are preferably spaced such that the walls 24 between adjacent tuft hole 23 in are approximately from about 0.0001 mm thick to about 0.01 mm thick, are more preferably about 0.0005 mm thick to about 0.005 mm thick, and are most preferably approximately 1/100,000 inch or about 0.000250 mm in thickness. Alternately, or in addition to the bristle density pattern of the tufts 34, the tufts 34 may be disposed in a spiral pattern, or double spiral pattern along the support column 40 for maximum density, which may be enhanced by using a closed wound pattern with an approximately zero pitch.

Where the rotating brush 30, or stationary brush 28 if present, comprise a spiral pattern of tufts 34 about the length of the rotating 30 or stationary brush 28, the spiral pattern is preferably disposed along substantially the entire length of the cleaning brushes 28, 30*a*, 30*b* and is at an approximately 20-degree to about 45-degree, and most preferably at an approximately 30-degree angle, to the long axis 35 of the support column 40 for optimal cleaning, although other angles may be suitable.

The diameter of the tufts 34 at the tuft base 33 in Example I of the preferred embodiment is preferably approximately 0.005 cm to about 5.0 cm, is more preferably between approximately 0.01 cm and about 1.0 cm, and most preferably, is between about 0.015 cm and about 0.25 cm in diameter (or about 0.1 inch to about 0.005 inch), or approximately 0.08 cm, in diameter. In the preferred embodiment, the diameter of the distal portion 34 of the tufts is preferably slightly larger than that of the tuft base 33 so that the tuft 34 forms a cone shape.

In Example I of the preferred embodiment, the tufts 34 are preferably approximately 0.5 cm to approximately 25 cm in length, are more preferably approximately 0.75 cm to approximately 10 cm in length, and are most preferably, approximately 1 to approximately 5 cm, or approximately 2.5 cm (about one inch) in length. In one version of the preferred embodiment, the bristle portion 21 is configured so that the cleaning fluid is transported upwards towards and through the paintbrush, artist brush, arts & crafts brush or cosmetic brush 16 being cleaned via the spiral pattern on the cleaning brush(es) and the Archimedes screw principle.

In one variation of the preferred embodiment, the rotating brushes 30 are preferably held in the brush frame 8 by way of a drive shaft 42 and support column 40, wherein the drive shaft 42 preferably attaches to the brush frame 8 and sits within the support column 40 to support the rotating brushes 30 (FIG. 1). The drive shaft 42 is preferably arranged concentrically in the support column 40 of the rotating brushes 30. The stationary brush 28, if present, may also comprise a support column 40, and may be held securely to the brush frame 8 by suitable means know in the art, such as by screws or other suitable fasteners that secure the stationary brush support column 40 to the brush frame 8.

By way of example only, in Example I, the rotating brush 30 or brushes 30*a*, 30*b*, in an artist brush or cosmetic brush application, may be from approximately 50 cm to about 300 cm long, are more preferably from about 75 cm to about 150 cm long, and are most preferably between about 85 cm and about 100 cm long, or about 97 cm long. In Example I, the support column 40 may be from about 5.0 cm to about 100 cm in diameter, is more preferably from about 10 cm to about 75 cm in diameter, and is most preferably between about 40 cm and about 60 cm, or about 51 cm in diameter. The support column in Example I of the preferred embodiment may comprise a drive shaft 42 along the length of the support column 40, the drive shaft 42 in Example I preferably being from about 1.0 cm to about 95 in diameter, is more preferably from about 5.0 cm to about 50 cm in diameter, and is most preferably between about 10 cm and about 30 cm in diameter, or about 17 cm in diameter.

The drive shaft 42 in Example I of the preferred embodiment is preferably approximately 5.0 cm to about 250 cm long, is more preferably about 50 cm to about 150 cm, and is most preferably between approximately 75 cm to approximately 120 cm long, or about 115 cm long. In Example I of the preferred embodiment, the stationary brush 28, if present, may be approximately 10 cm to about 300 cm long, is more preferably about 50 cm to about 150 cm long, and is most preferably about 75 cm to 120 cm long, or about 100 cm long. The stationary brush 28, if present, may be about 10 cm to about 150 cm in diameter, is more preferably about 20 cm to about 100 cm in diameter, and is most preferably about 40 cm to about 75 cm, or about 50 cm in diameter In the preferred embodiment, the rotating brushes 30, where two brushes are present, do not touch, and the stationary brush 28, if present, preferably does not touch the rotating brush(es) 30. In the preferred embodiment, the distal ends 25 of the tufts 34 of the respective rotating brushes 30 do not touch, and the distal ends 25 of the tufts 34 of the stationary brush 28, if present, preferably do not touch the distal ends 25 of the tufts 34 of the rotating brush(es) 30.

In Example I of the preferred embodiment, the rotating 30 brush and the stationary brush 28, if present, are preferably disposed in a brush frame 8 preferably having a height of approximately about 5 cm to about 200 cm, more preferably of about 25 cm to about 150 cm in height, and most preferably have a height of about 75 cm to about 120 cm, or approximately 90 cm in height. The brush frame 8 in Example I of the preferred embodiment preferably has a width of approximately about 1.0 cm to about 200 cm, more preferably has a width of about 5 cm to about 100 cm, and most preferably has a width of about 10 cm to about 30 cm, or about 12 cm. The brush frame 8 in Example I of the preferred embodiment preferably has a depth of approximately about 10 cm to about 250 cm, more preferably is between approximately 150 cm to approximately 25 cm in depth, and is most preferably from about 75 cm to about 125 cm in depth, or about 90 cm in depth.

In the preferred embodiment, the support column 40 of at least one of the rotating brushes 30 may comprise at least one gear 44 that directly or indirectly interfaces with a power source. The power source may comprise an electric or battery operated motor (not shown), a manual hand crank (not shown), or devices comprising a paddlewheel or operating on hydrodynamic principles, such as, for example, those where the kinetic energy of a jet of water is transformed into power at the shaft of the paddle of a paddlewheel. In the preferred embodiment, the rotating brush(es) 30 turn as power is applied to the gear 44. It is preferable that the gears and power source are configured so that the rotating brush(es) 30 are each turned inward toward the paintbrush, artist brush arts & crafts or cosmetic brush to be cleaned or sanitized. In an alternative embodiment, the brush cleaning device may be operated without a motor, hand crank, paddlewheel or similar power source, such as by using the operator's up and down and/or sideways motion of the paintbrushes, cosmetic brushes or arts & crafts brushes to be cleaned with a pair of stationary brushes.

In Example I, the drive gear 44 is preferably about 5 cm to about 150 cm in diameter, more preferably is about 10 cm to about 100 cm in diameter, and is most preferably about 20 cm to about 50 cm in diameter, or approximately 35 cm in diameter. In Example I of the preferred embodiment, a suitable motor, if present, may be a 12v electric motor with counter clockwise rotation with a speed of approximately 20600 rpm and a torque of approximately 49.4 mN-m, or other suitable motor known in the art. In one version of an alternate embodiment, the stationary brush 28 and rotating brushes 30 are configured so that the operator's up and down movement of the paintbrush or cosmetic brush in the device replaces the power source, such as the motor or hand crank.

Figure 4A:
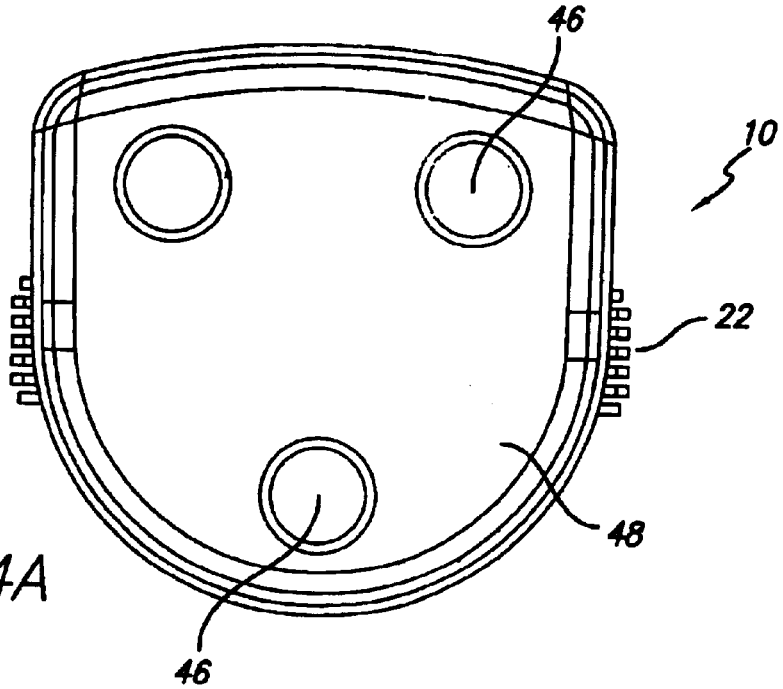
FIG. 4(*a*) is a bottom view of the tank according to a preferred embodiment of the present invention.
Figure 4B:
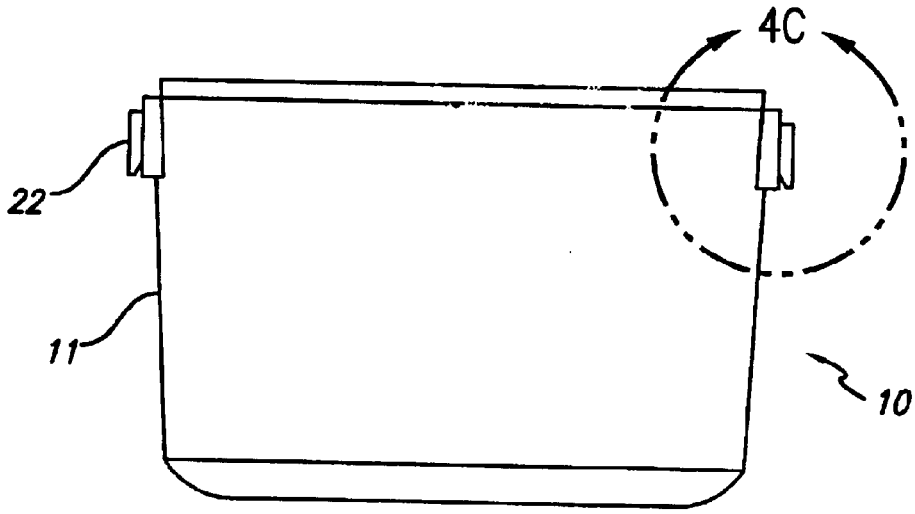
Figure 4C:
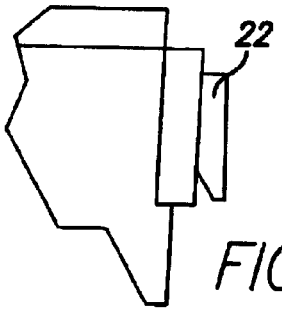

The tank 10 may be comprised of suitable materials known in the art, such as polyethylene, and preferably comprises non-skid feet 46 arranged in a suitable pattern to stabilize the device, such as at each corner on the outer bottom surface 48 of the tank 10 or at three points on the outer bottom surface 48 of the tank 10, as shown in FIG. 4*a*. By way of example only, In Example I of the preferred embodiment, the tank 10 may be approximately 10 cm to about 200 cm high, is more preferably about 25 cm to about 150 cm high, and is most preferably between about 50 cm to about 100 cm high, or about 80 cm high. In Example I of the preferred embodiment, the tank 10 is preferably about 10 cm to about 300 cm wide, is more preferably about 50 cm to about 250 cm wide, and is most preferably about 100 cm to about 175 cm, or about 148 cm wide. The tank 10 in Example I is preferably between about 10 cm to about 300 cm deep, is more preferably about 50 cm to about 250 cm deep, and is most preferably about 175 cm to about 200 cm deep, or about 150 cm deep, although other suitable dimensions may be used.

The brush frame 8 in the preferred embodiment is preferably configured so that it sits within the tank 10 above the bottom of the tank 10. This may be accomplished, for example, by way of support elements 50*a*, 50*b* disposed at the upper end of the brush frame 8 (see FIG. 1) that interface or rest upon the upper edge 27 of the tank 10, so that the brush frame is immersed in the cleaning fluid in the tank 10, but is supported above the bottom of the tank 10.

In the preferred embodiment, the motor housing 6, brush frame 8 and motor, if present, together with the motor cowling 4 are preferably manufactured such that they are secured or can be fitted together. For example, in one version of the preferred embodiment, the motor housing 6, the brush frame 8, and the tank 10 are preferably secured together by way of a latch catch 22, an articulating "Y-arm" 29 and a latch handle 26, although other types of suitable securing means known in the art may be used. In one version of the preferred embodiment, the latch catch 22 may be disposed on the tank 10 and the latch handle 26 may be disposed on the motor housing 6 so that the tank 10, brush frame 8, motor and motor housing 6 will be stable and secured once the latch handle 26 is in a locked position. Once secured, the interface between the motor housing 6 and tank 10 and the interface between the motor housing 6 and top cover 2 will be substantially sealed, which may be accomplished by the action of the latch handle 26, latch catch 22 and Y-arm 29 with a sealing means, such as for example, disposing an O-ring, rubberized gasket or other suitable sealing means, at each interface to be substantially sealed.

In one version of the preferred embodiment, the latch handle 26 may be placed in the locked position by engaging the bottom of the latch handle 26 with the latch catch 22 and moving the latch handle in a direction that causes the articulating Y arm 29 to move from a first extended position to a second parallel position to the wall 11 of the tank 10, thereby pulling with it the latch handle 26. To lock the latch handle 26, the operator engages an end of the latch handle 26 with the latch catch 22 and applies slight pressure to the opposite end, or top, of the latch handle 26 so that the latch handle 26 moves to the parallel position, and is thereby in the locked position. To release the latch handle, the operator applies slight pressure to one end, or the top end, of the latch handle 26 to move the latch handle 26 to the extended position, which will release the opposite end, or bottom, of the latch handle 26 from the latch catch 22.

To operate the invention in the preferred embodiment, the user fills the tank 10 with water for cleaning materials such as water-base makeup; watercolor paints or acrylic paints or with a nonflammable cleaning fluid for oil based materials such as makeup or paint. Once the tank 10 has been filled, the user then preferably lowers the motor housing 6 onto the tank 10 and locks the latch handle 26. In a variation of the preferred embodiment, the brush frame 8 is not manufactured integral with the motor housing 6, in which case, it would be lowered onto the tank 10 prior to lowering the motor housing 6 onto the tank 10 and locking the latch handle. Preferably, the top cover 2 has already been secured in place on the motor housing 6 or motor housing unit, but the device may also be configured so that the top cover 2 is a removable component that is fitted in place at the upper surface of the motor housing 6 prior to operation of the device. In the preferred embodiment, once the tank 10, motor housing 6, brush frame 8 and top cover 2 have been secured in place, the device is plugged into a electrical wall outlet and a power switch 52 on the device is depressed so that power flows to the motor. The user then lowers a paintbrush, artist brush or cosmetic brush into the throat opening 12 until a light tug is felt on the paintbrush or cosmetic brush. Preferably the user strokes the brush up and down and from side to side for approximately 15–30 seconds to clean the paintbrush or cosmetic brush. Excess water may be removed from the paintbrush or cosmetic bush by pressing on brush groomers 54 disposed on the top cover 2. The brush groomers 54 may be comprised of ridges or protrusions integral with or secured to the top cover 2 to create a squeegee-like action on the paintbrush or cosmetic brush to remove fluid. The cleaned brushes may then be stored in an upright position for drying.

In an alternate embodiment of the paintbrush, artist brush, arts & crafts brush and cosmetic brush cleaning device, the device may include a distribution manifold and jet nozzles as disclosed in U.S. Pat. No. 6,666,925, with the jet nozzles and distribution manifold being sized for the particular application and brush cleaning device dimensions. In the alternate embodiment, the paintbrush, artist brush, arts & craft brush or cosmetic brush to be cleaned may be positioned between the bristle portions 21 of the rotating brushes by impaling the heel portion 17 of the paintbrush, artist brush or cosmetic brush on the jet nozzles, as described in U.S. Pat. No. 6,666,925.

In Example I of the preferred embodiment, the distance between the end tips of tufts 34 of the rotating brushes 30*a*, 30*b* may be approximately 0.5 cm to about 25 cm, is more preferably 0.75 cm to about 10 cm, and is most preferably between approximately 1.0 and about 5.0 cm, or about 1.6 cm (about ⅝ inch). In Example I of the preferred embodiment, the bristle portion 21 of the rotating brushes 30 is preferably configured in a spiral pattern and the distance between the spirals of bristle portion 21 is preferably between approximately 0.25 cm to about 25 cm, is more preferably 10.0 cm to about 5.0 cm and is most preferably between about 1.0 cm and about 5 cm, or about 1.3 cm to about 1.9 cm (about ½ inch to ¾ inch).

The rotating brush 30 and/or stationary brush 28 may also comprise a spiral pattern of alternating areas of long and/or short single tufts 34, or clumps of long and/or short tufts 34. The tufts 34 of the rotating brush 30 and stationary brush 28, if present, may be comprised of suitable materials known in the art, such as for example, solid nylon #12 or polypropylene.

While the present invention has been described with regards to particular embodiments, it is recognized that additional variations of the present invention may be devised without departing from the inventive concept.

What is claimed is:

1. A brush cleaning device to clean artist brushes, paint brushes and cosmetic brushes, said device comprising:

(a) a tank having closed sides and a bottom defining an interior;

(b) a brush frame disposed within the tank, said brush frame comprising at least a first rotating cleaning means and a second rotating cleaning means, wherein, the rotating cleaning means each comprise a bristle portion;

(c) a motor housing comprising a first opening connecting to the tank; and (d) a top cover disposed on the upper surface of the motor housing, said top cover comprising a second opening in communication with the first opening and with the tank; wherein the bristle portion of the first rotating cleaning means does not touch the bristle portion of the second rotating cleaning means.

2. The brush cleaning device of claim 1, wherein the first rotating cleaning means and the second rotating cleaning means are disposed parallel to one another.

3. The brush cleaning device of claim 1 wherein the first rotating cleaning means and the second rotating cleaning means are configured to rotate towards the interior of the tank.

4. The brush-cleaning device of claim 1 wherein the bristle portion of the first rotating cleaning means and the second rotating cleaning means comprise a plurality of tufts extending outward from the their respective outer surfaces.

5. The brush-cleaning device of claim 4 wherein the plurality of tufts is configured in a spiral pattern along substantially the entire length of the first and second rotating cleaning means.

6. The brush cleaning device of claim 4, wherein the tufts are disposed in tuft holes and wherein adjacent tuft holes are separated by a wall.

7. The brush cleaning device of claim 6, wherein the wall between adjacent tuft holes has a thickness, and wherein the thickness is from about 0.0001 mm thick to about 0.1 mm thick.

8. The brush cleaning device of claim 7, wherein the wall between adjacent tuft holes has a thickness, and wherein the thickness is from about 0.0005 mm thick to about 0.005 mm thick.

9. The brush cleaning device of claim 8, wherein the wall between adjacent tuft holes has a thickness, and wherein the thickness is about 0.00025 mm thick.

10. The brush cleaning device of claim 4, wherein the tuft comprises a tuft base, and wherein the diameter of the tuft at the tuft base is from about 0.005 cm to about 5.0 cm.

11. The brush cleaning device of claim 10, wherein the tuft comprises a tuft base, and wherein the diameter of the tuft at the tuft base is from about 0.01 cm to about 1.0 cm.

12. The brush cleaning device of claim 11, wherein the tuft comprises a tuft base, and wherein the diameter of the tuft at the tuft base is from about 0.015 cm to about 0.25 cm.

13. The brush cleaning device of claim 4, wherein the tuft comprises a length and wherein the length is from about 0.5 cm to about 25 cm.

14. The brush cleaning device of claim 13, wherein the tuft comprises a length and wherein the length is from about 0.75 cm to about 10 cm.

15. The brush cleaning device of claim 14, wherein the tuft comprises a length and wherein the length is from about 1 cm to about 5 cm.

16. The brush cleaning device of claim 1, further comprising a means for providing power to rotate the rotating cleaning means and, wherein the means for providing power to rotate the rotating cleaning means is selected from the group consisting of electric motors, battery-operated motors and manual cranks.

17. The brush-cleaning device of claim 16 wherein said rotating cleaning means comprises at least one gear that communicates with a drive gear in communication with the means for providing power.

18. A brush cleaning device to clean artist brushes, paint brushes and cosmetic brushes, said device comprising:

(a) a tank having closed sides and a bottom defining an interior, wherein the tank comprises a latch catch;

(b) a brush frame disposed within the tank, said brush frame comprising lower ends and at least a first rotating cleaning means and a second rotating cleaning means, wherein, the first and second rotating cleaning means are disposed parallel to one another and each comprise a bristle portion;

(c) a stationary cleaning means comprising a bristle portion, wherein the stationary cleaning means is disposed between the lower ends of the brush frame and (d) a motor housing comprising a first opening connecting to the tank and at least one latch handle;

(e) a top cover disposed on the upper surface of the motor housing, said top cover comprising a second opening in communication with the first opening and with the tank; wherein the latch handle interfaces with the latch catch to secure the motor housing to the tank, and wherein the respective bristle portions of the first rotating cleaning means, second rotating cleaning means and stationary cleaning means do not touch one another.

* * * * *